US005364143A

United States Patent [19]

Grady

[11] Patent Number: 5,364,143

[45] Date of Patent: Nov. 15, 1994

[54] METHOD AND APPARATUS FOR CARPET STRETCHING

[76] Inventor: Eugene J. Grady, 5 Pheasant Run, East Bridgewater, Mass. 02333

[21] Appl. No.: 129,268

[22] Filed: Sep. 30, 1993

[51] Int. Cl.[5] ..... A47G 27/04

[52] U.S. Cl. ..... 294/8.6; 254/209

[58] Field of Search ..... 294/8.6; 254/200, 205, 254/206, 209-212; 81/463, 27

[56] References Cited

U.S. PATENT DOCUMENTS

| | | | |
|---|---|---|---|
| 343,462 | 6/1886 | Lane et al. | 254/209 |
| 356,417 | 1/1887 | Morgan | 254/209 |
| 456,432 | 7/1891 | Rounkles | 254/209 X |
| 624,873 | 5/1899 | Sapper | 254/211 X |
| 870,671 | 11/1907 | Freed | 254/211 X |
| 3,659,331 | 5/1972 | Drake et al. | 254/209 X |
| 3,940,170 | 2/1976 | Williams | 294/8.6 |
| 4,509,725 | 4/1985 | Talavera | 254/212 |
| 4,538,846 | 9/1985 | Alexander | 294/8.6 |
| 4,785,692 | 11/1988 | Holmes | 81/463 X |
| 5,214,987 | 6/1993 | Fenton, Sr. | 81/463 X |

FOREIGN PATENT DOCUMENTS 2202737 10/1988 United Kingdom ..... 294/8.6

*Primary Examiner*—Dean J. Kramer

*Attorney, Agent, or Firm*—Cesari and McKenna

[57] ABSTRACT

A hand-operated carpet stretcher has a first handle securely attached to an otherwise conventional gripping head engagable with a carpet, and a second handle securely attached to a drive member or mass. The gripping head and drive member are interconnected by a telescoping shank supported on a skid. The shank has an outer, elongated tube connected to the gripping head, and an inner shaft connected to the drive member and terminating in a hammer that is slidingly received within the outer tube. During operation, a carpet installer holds the drive and head handles, and thrusts the drive member in a forward direction towards the gripping head while the tubes telescope together. After a period of free travel during which the drive member develops momentum, the hammer strikes an abutment or anvil provided within the outer tube adjacent to the gripping head. The sudden impact of the hammer on the anvil causes the gripping head to move in the forward direction, thereby stretching the carpet.

10 Claims, 2 Drawing Sheets

METHOD AND APPARATUS FOR CARPET STRETCHING

BACKGROUND OF THE INVENTION

A. Field of the Invention

This invention relates generally to carpet stretching tools for use during laying of carpets.

B. Description of the Related Art

During the installation of wall-to-wall carpet, an installer typically first secures tacking boards on the floor adjacent to the walls of the room. The installer secures an end of the carpet to the tacking boards located on one side of the room. Then, the installer uses a carpet stretching tool to stretch the carpet prior to securing the other end of the carpet to the tacking boards on the opposite side of the room. Stretching the carpet in this way reduces or eliminates wrinkling in the carpet.

A conventional carpet stretching tool is known as the "knee kicker." It has a gripping head at one end furnished with prongs or teeth for engaging and gripping into the carpet, and a padded kicker plate at the other end. An elongate shank typically interconnects the gripping head and kicker plate. The shank often has telescoping elements, e.g., an inner tube connected to the kicker plate and an outer tube connected to the gripping head. The tubes are mounted for translation, one within the other, so as to permit the length of the shank to be continuously adjustable during set up of the tool.

During use of the conventional knee kicker, the installer first sets up the tool by adjusting the length of the shank of the tool, and then actuating a lock mechanism to interlock the shank's tubes to prevent their relative motion. Afterwards, during use, the installer bumps or strikes the kicker plate with his knee. This action causes the tube attached to the kicker plate to impact a stop or strike plate in the outer tube with sufficient momentum to thrust the gripping head forward, thereby stretching the carpet.

While knee kickers are generally suitable for their intended purpose and are widely used, they do have certain drawbacks. For example, it is difficult to use knee kickers effectively in tight spaces, such as in hallways or stairs. Such spaces often do not provide sufficient room for the installer to place his knee in a "kicking" position behind the padded kicker plate.

Moreover, experience has shown that prolonged use of the knee kicker can cause injury to the knee; the knee is not meant to be used as a hammer. Professional carpet installers can suffer not only painful bruises resulting from using the knee kicker, but, over time, can even develop permanent knee trouble or disability. This can prove expensive for carpet installation companies that have to pay workers compensation for such injuries. Inexperienced carpet installers, such as "do-it-yourselfers", may be even more prone to injury, according to reports from stores that rent knee kickers.

These drawbacks with knee kickers have been recognized heretofore. U.S. Pat. No. 3,940,170 proposed a modified knee kicker that has a kick plate connected by a rigid shank to a gripping head, and also has a so-called "hand weight" that can slide along the shank. That patent's carpet stretcher can be operated by striking the kicker plate with the knee. That patent's carpet stretcher can alternatively be operated by hand by propelling the hand weight from a position along the shank adjacent the kicker plate to a position adjacent the gripping head at which the hand weight strikes a stop in hammer-like fashion. Unfortunately, the limited free travel or "throw" of the hand weight along the shank prevents the hand weight from developing much momentum before it strikes the stop. Thus, hand operation of that carpet stretcher would not be particularly effective at stretching carpet.

Another conventional type of carpet stretcher employs a tail block or butt plate in addition to a carpet gripping head. The installer positions the tail block against a wall of the room, and hand operates a toggle-type mechanism near the gripping head to drive the gripping head away from the tail block. While such a carpet stretcher avoids the necessity of using the installer's knee as a hammer, it can require considerable and time-consuming assembly and set up for use, in addition to fortuitously placed walls that are usable for this purpose.

Accordingly, it would be desirable to provide an efficient carpet stretching tool that is not actuated by the installer's knee, that can be used in tight spaces, and that does not require any significant set up or assembly for use.

DESCRIPTION OF THE INVENTION

A. SUMMARY OF THE INVENTION

The present invention resides in a hand-operated carpet stretching tool having a first handle securely attached to an otherwise conventional gripping head and a second handle securely attached to a drive member or mass of, e.g., about three to five pounds in weight. The drive member takes the place of the padded kicker plate of the conventional knee kicker. The gripping head and drive member are interconnected by a telescoping shank, which can lengthen to an "extended position" at which the total distance between the handles is, e.g., about 38 inches (96 cm) and can compress during installation of a carpet to a "retracted position" at which the total distance between the handles is reduced by about a third or more, e.g., to about 26 inches (66 cm).

The shank has an outer, elongated element, e.g., tube, connected at an end to the gripping head, and a second (e.g., inner) elongated element, e.g., shaft, connected at an end to the drive member. The free end of the shaft is slidingly received coaxially within the free end of the outer tube for translation within the outer tube in piston-like fashion. The free end of the outer tube is supported on the floor during use by a skid.

During operation, the carpet installer holds the "drive" and "head" handles, while the gripping head engages the carpet, and the shank rests on the skid. The installer pulls the drive handle toward the other; thereby moving the drive member in a forward direction towards the gripping head while the shaft and tube portions of the shank telescope together. After a period of free travel during which the drive member develops momentum, the forward, distal end of the shaft, which is provided with a strike element called a hammer, hits an abutment or strike surface provided on an anvil within the outer tube adjacent to the gripping head. The sudden impact of the hammer on the strike surface causes the gripping head to move in the forward direction, thereby stretching the carpet.

An elastomeric bumper can be used intermediate the hammer and anvil to prevent scoring or other damage to these components from repeated impacts and to reduce vibration.

Since the drive handle is located at about 26 inches, i.e., a little over a "shoulder" width, from the head handle at the end of its stroke, and well in excess of that at the beginning of the stroke, the installer can use the muscles of his entire arms and shoulders to propel the drive member with considerable force. Thus, the tool provided by the invention is designed ergonomically for effectiveness as well as comfort and safety.

This should be contrasted with the knee kicker, which does not have a shank portion that telescopes during installation of carpet, and which, while effective (at least in a large space with plenty of room), can cause injury to the installer's knee.

This should also be contrasted with the above-described patent's carpet stretcher, in which the hand weight appears to move just a few inches, ending its travel directly against the gripper head without significant momentum-building travel. Such an arrangement would use mainly the muscles in the forearms and wrists, would not develop the same force as in the present invention, and would fatigue the installer more quickly.

In summary, the invention does not require the use of the installer's knee to stretch a carpet. Since a carpet installer can operate the tool while kneeling next to it rather than assuming a position behind a kick plate as in the conventional knee kicker, the invention can be operated in tight places. The invention does not require any significant set up or assembly for use. Moreover, the invention is ergonomically designed for efficient and effective operation.

B. BRIEF DESCRIPTION OF THE DRAWINGS

For a fuller understanding of the nature of the invention, reference should be had to the following detailed description taken in connection with the accompanying drawings, in which.

C. DETAILED DESCRIPTION OF THE INVENTION

Figure 1:
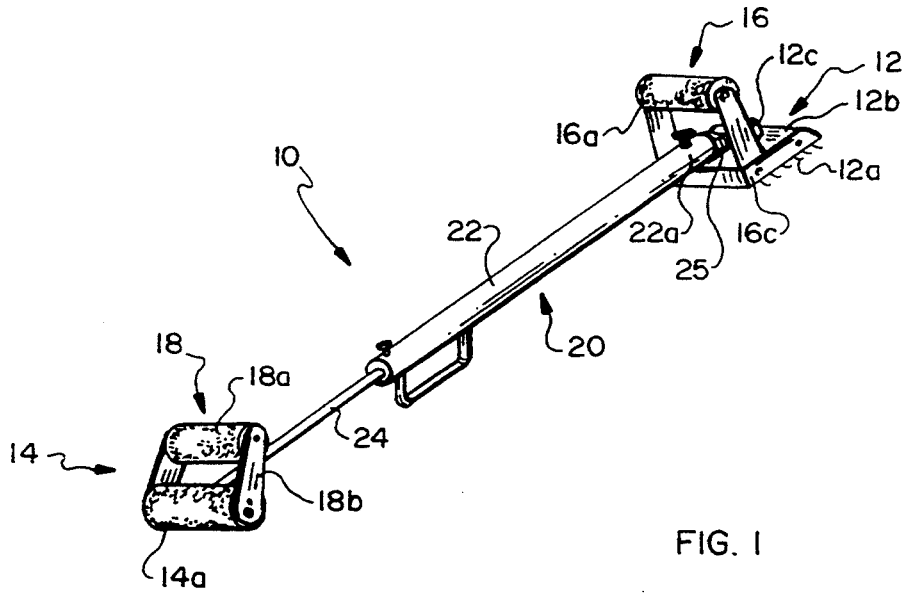
FIG. 1 is a perspective view showing a hand-operated carpet stretcher in accordance with an illustrative embodiment of the invention.

FIG. 1 shows a carpet stretcher 10 in accordance with the invention. The carpet stretcher 10 includes a gripping head 12 for gripping or engaging a carpet (not shown), and a drive member 14 interconnected with the gripping head 12 by a telescoping, elongated shank 20. The gripping head 12 and drive member 14 have respective handles 16 and 18.

The gripping head 12 is generally of conventional construction, having prongs or teeth **12*a* that extend from a body portion 12*b* for engaging and gripping into the carpet. Preferably, the teeth 12*a* are of a length that can be adjusted depending on the application using a knob 12*c* disposed on the gripping head 12. What is not conventional about the gripping head 12 is the addition of handle 16. The handle 16 is preferably a "U" shaped element, having a preferably padded, horizontal grip 16*a* spaced from the body portion 12*b*. The handle 16 also has elongate end portions 16*b* connected at one end to the grip 16*a* and connected at a second end, e.g., by a perpendicularly extending, mounting flange 16*c* to the body 12*b* of the gripping head 12**.

The drive member 14 comprises, e.g., an elongated, cylindrically shaped element **14*a* of significant mass, e.g., about three to five pounds in weight. The drive member 14 is connected orthogonal approximately mid way along its length to the shank 20 in a "T" shaped arrangement. The handle 18, like handle 16, is preferably a "U" shaped element, provided with a similar grip 18*a*, and connected at its ends portions 18*b* to the drive member 14. Preferably, the handles 16, 18** are inclined toward one another, e.g., at 60° to 75°.

Figure 2:
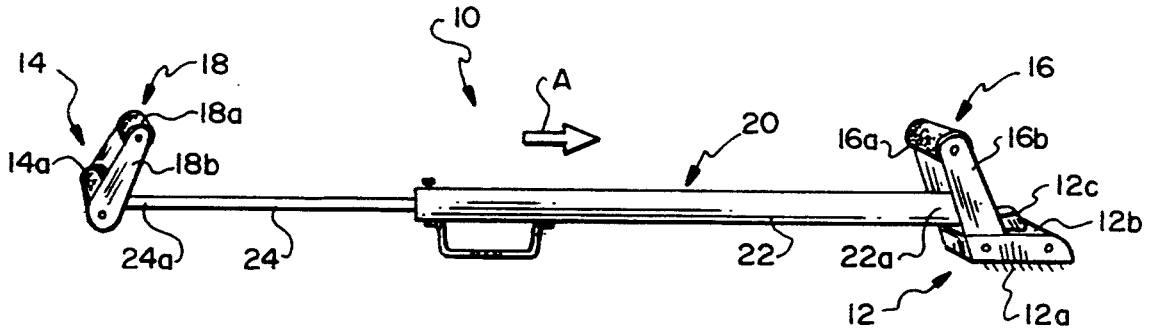
FIGS. 2 and 3 are side elevational views of the carpet stretcher of FIG. 1 in respective extended and retracted positions.
Figure 3:
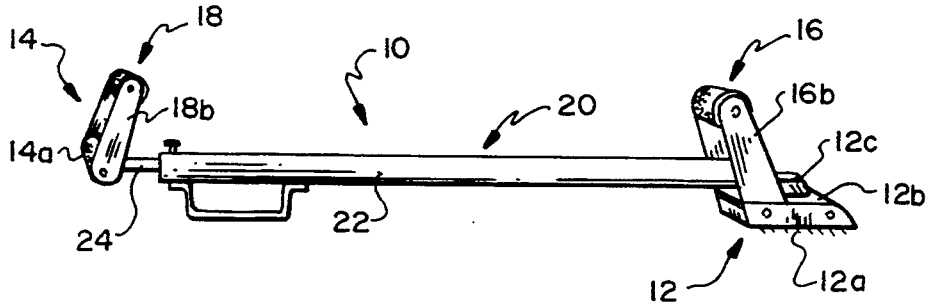

The telescoping shank 20 is formed from coaxially-arranged, outer and inner elements, e.g., an outer tube 22 and an inner shaft or rod 24. The tube and shaft 22, 24 are capable of telescoping motion, the shaft 24 sliding or passing within the tube 22 in piston-like fashion. Consequently, the carpet stretcher 10 can assume a retracted position, shown in FIG. 3, in which the shaft 24 is telescoped into the tube 22 to a maximum extent, and can assume an extended position, shown in FIG. 2, in which the shaft 24 is telescoped out of the tube 22 to a maximum extent.

The distance that the drive member 14 travels between the extended and retracted positions is called the "maximum throw" of the tool 10. For example, with a total distance between the handles in the extended position being about 38 inches (96 cm), and in the retracted position being about 26 inches (66 cm), the maximum throw is about 12 inches (30 cm). Accordingly, even in the retracted position, the handles 16, 18 are separated by a significant distance, which is about equal to the length of the tube 22.

Figure 4:
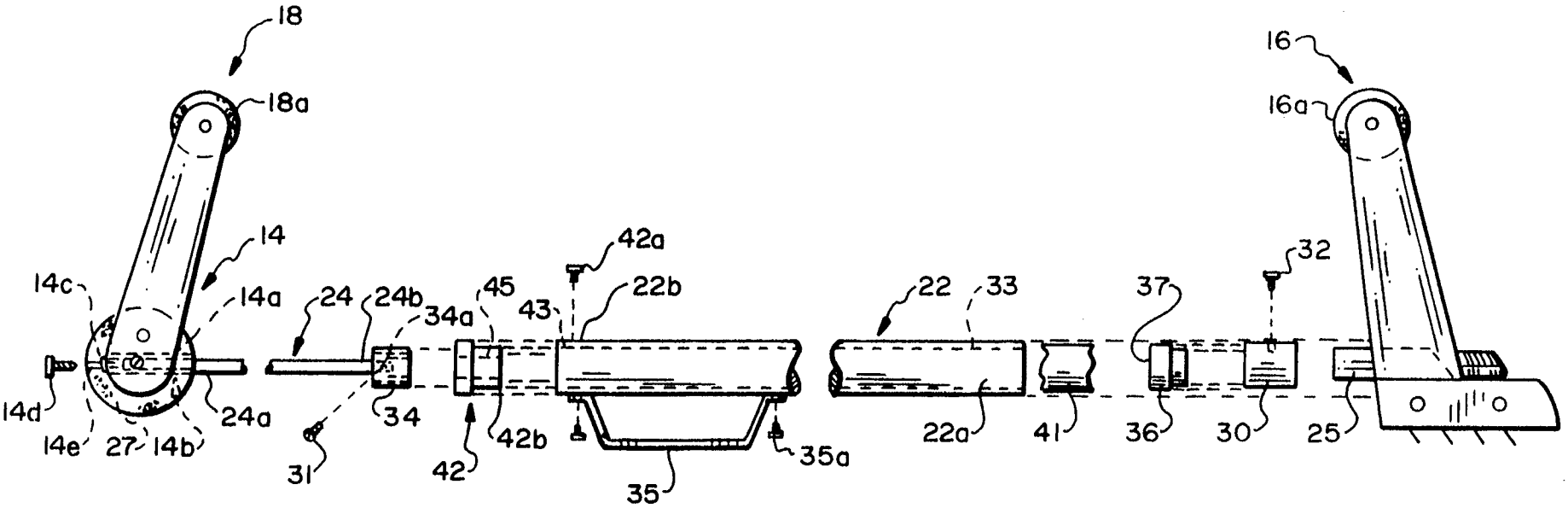
FIG. 4 shows an exploded view of components of the carpet stretcher of FIG. 1.

FIG. 4 shows the construction of the carpet stretcher 10 in greater detail. As shown, the shaft 24 is secured to the drive member 14 in the following way. The first end **24*a* of the shaft 24 is received within a larger-diameter portion 14*a* of a stepped through-bore 14*b* in the drive member 14, and bears against an annular wall 14*c* therein. The shaft 24 is secured to the drive member 14 by a screw 14*d*, which is received within a smaller-diameter portion 14*c* of the through-bore 14*b*, and is threadedly engagable with a bore 27 extending coaxially within the first end 24*a* of the shaft 24**.

A second or free end **24*b* of the shaft 24 is slidingly received in a second or free end 22*b* of the outer tube 22. The shaft free end 24*b* terminates in a cylindrical element 34, called a hammer. The hammer 34 is made, e.g., of steel and is attached to the shaft 24 by any suitable expediency, e.g., screw 31. The hammer 34 has a plurality of air holes 34*a* therethrough, extending parallel with the central axis of the hammer 34 and the shaft 24. The free end 22*b* of the outer tube 22 has a support skid 35, e.g., of "U"-shape, for supporting the shank 20** on the floor (not shown).

FIG. 4 further shows a cylindrical connector 30 for mounting the tube 22 to a mounting extension 25 of the gripping head 12. The tube end **24*a* fits over the connector 30, which, in turn, fits over the extension 25. A suitable expediency, such as a screw 32, extends through hole 33 in the tube 22 and threadedly engages the connector 30 and the extension 25**.

To the left of the connector 30 in FIG. 4 is an anvil 36. The anvil 36 is made, for example, of steel, and is secured to the connector 30, e.g., by press-fitting or welding. A bumper 41 made of a hard, resilient elastomeric material may be disposed within the tube 22 as well, immediately between the anvil 36 and the hammer 34, though spaced from the hammer when the tool 10 is in the extended position.

The free end 22*b* of the tube 22 is closed by an end cap or bushing 42. The bushing 42 is made of, e.g., Nylon material, and is secured, e.g., by a screw 42*a*, to the tube free end 22*b*. The screw 42*a* is received through hole 43 in the tube 22, and, threadingly engages hole 45 in the bushing 42.

The bushing 42 retains the hammer 34 within the tube 22 and limits extension of the telescoping shank 20, i.e., limits the distance by which the shaft 24 can be pulled from the tube 22. To that purpose, the bushing 42 has a through-hole 42*b* of a diameter greater than that of the shaft 24, so that the shaft can freely slide through the through-hole 42*b*. The diameter of the through-hole 42*b* is less than that of the hammer 34, however, so that the hammer 34, and thus the shaft 24, can not be removed from the tube 22 when the bushing 42 is secured in place.

During assembly of the carpet stretcher 10, and with reference to FIGS. 1–4, one end of the connector 30 is placed over the extension 25. The anvil 36 is fitted in the free end of the connector 30, e.g., press-fitted or welded thereto. The bumper 41 and the free end of the connector 30, with the anvil 36 attached, are placed in the first end 22*a* of the tube 22. Screw 32 is used to attach the extension 25, connector 30 and tube 22. The second end of the shaft 24 is placed in the stepped through-bore 14*b*, and screw 14*d* is used to secure the shaft 24 to the drive member 14. Preferably, the drive member 14, shaft 24 and hammer 34 (FIG. 4) together weigh five to eight pounds, or even more, depending on the application. The bushing 42 is placed over the free end 24*a* of the shaft 24. Then, the hammer 34 is attached to the shaft 24 via screw 31. The hammer 34 and first end 24*a* of the shaft 24 are placed within the first end of the tube 22, and the bushing 42 is fitted within the tube end 22*b*, and secured by screw 42*a*. Finally, the support skid 35 is attached to tube 22 by screws 35*a* or, alternatively, by welding.

During operation, and with renewed reference to FIG. 1, a carpet installer first places the carpet stretcher 10 in an extended configuration, in which the inner tube 24 extends to a maximum extent from the outer tube 22. Then, the installer sharply pulls the drive handle 18 in a forward direction (designated "A" in FIG. 2) towards the gripping head 12, while holding the head handle 16 for leverage. By doing so, the drive member 14 is thrust towards the gripping head 12, while the tubes 22, 24 telescope together. After a period of free travel, during which the drive member develops momentum, the hammer 34 (FIG. 4) at the free end 24*b* of the shaft 24 strikes a strike surface 37 of the anvil (FIG. 4) directly or via bumper 41. This occurs when the carpet stretcher 10 is in its retracted or compressed configuration. The sudden impact of the hammer 34 on the anvil 36 causes the gripping head 21 to move forwardly, thereby stretching the carpet.

In some applications, it would be desirable to permit the angular orientation of the driver handle 18 relative to the head handle 16 to self-adjust during use for comfortable and effective gripping of the handle 18 by the installer. This can be particularly useful in tight or cramped spaces. In other applications, however, it may be desirable to maintain both handles 16 and 18 at fixed angular orientations such that, e.g., the handle grips 16*a* and 18*a* are in parallel, horizontal relationship to one another and perpendicular to direction A or in some other pre-selected relative orientation. For that purpose an anti-rotation arrangement (not shown) can be employed on the shank 20, e.g., a pin-in-groove arrangement.

Accordingly, it will be seen that a novel method and apparatus for stretching carpet has been described. The terms and expressions that have been employed herein are terms of description and not of limitation. In the use of such terms and expressions, there is no intention of excluding any equivalents of the features shown and described. For example, the shaft and tube can be reversed, such that the tube is attached to the drive member and the shaft is attached to the gripping head. It is recognized that various modifications are possible within the scope of the invention as claimed.

What is claimed is:

1. A hand-operated, carpet stretching tool comprising:

A) gripping head engagable with a carpet;

B) a drive member;

C) an elongated shank for interconnecting said gripping head and said drive member; said shank including first and second members capable of telescoping motion of one relative to the other, said first member being connected proximate one end thereof to said gripping head, and said second member being connected proximate one end thereof to said drive member;

D) a first handle connected to said drive member for moving said drive member by hand in a first direction towards said gripping head;

E) a strike surface disposed adjacent said gripping head, against which said second member strikes during stretching of said carpet; and F) a second handle connected to said gripping head for holding said gripping head while said drive member is moved by said first handle towards said gripping head during telescoping of said first and second members so as to develop momentum before said first member hits said strike surface.

2. The carpet stretching tool in accordance with claim 1, wherein said first and second handles are each of a generally "U" shape, and include a grip.

3. The carpet stretching tool in accordance with claim 1, wherein said first and second handles are inclined toward one another.

4. The carpet stretching tool in accordance with claim 1, wherein said second member terminates with a hammer, and said tool further includes an anvil disposed adjacent said gripping head, said anvil including said strike surface against which said hammer strikes during stretching of said carpet.

5. The carpet stretching tool in accordance with claim 4, further including an elastomeric bumper disposed between said hammer and said anvil.

6. The carpet stretching tool in accordance with claim 4, further including an end cap securable to said first member for preventing removal of said second member therefrom.

7. The carpet stretching tool in according with claim 1, further including a support element for supporting said shank intermediate said gripping head and drive member.

8. A hand-operated, carpet stretching tool comprising:

A) gripping head engagable with a carpet;

B) a drive member;

C) an elongated shank for interconnecting said gripping head and said drive member; said shank including a tube and a shaft capable of telescoping motion, said shaft movable within said tube, said tube connected proximate one end thereof to said gripping head, and said shaft being connected proximate one end thereof to said drive member, said shaft terminating with a hammer;

D) a support element for supporting said shank intermediate said gripping head and drive member;

E) a first handle connected to said drive member for moving said drive member by hand in a first direction towards said gripping head;

F) an end cap securable to said tube for preventing removal of said shaft therefrom;

G) a second handle connected to said gripping head for holding said gripping head by hand while said drive member is moved by said first handle towards said gripping head while said shaft telescopes within said tube, said first and second handles are each of a generally "U" shape, include a grip, and are inclined toward one another; and H) an anvil disposed adjacent said gripping head, wherein said shank can lengthen to an extended position and can compress during said telescoping motion to a retracted position at which said hammer strikes said anvil, and wherein, in said retracted position, said first and second handles are spaced at a substantial distance approximately equal to the length of said tube.

9. The carpet stretching tool in accordance with claim 8, further including an elastomeric bumper disposed between said hammer and said anvil.

10. A method for stretching a carpet comprising the steps of:

A) engaging a carpet with a gripping head;

B) holding the gripping head by a handle;

C) holding a drive member by a handle, said drive member and said gripping head being interconnected by an elongated shank including a first member connected proximate one end thereof to said gripping head, and a second member connected proximate one end thereof to said drive member and receivable within said first member;

D) after steps (A)–(C), driving said drive member towards said gripping head; and E) during step (D), telescoping together said first and second members until said second member butts against a strike plate, causing said gripping head to stretch said carpet.

* * * * *